US005192633A

United States Patent [19]

Iwasaki et al.

[11] Patent Number: 5,192,633

[45] Date of Patent: Mar. 9, 1993

[54] LAMINATE TYPE PHOTOSENSITIVE MATERIAL FOR ELECTROPHOTOGRAPHY

[75] Inventors: Hiroaki Iwasaki, Hirakata; Youichi Takesawa, Suita; Hiroshi Takemoto, Osaka; Masashi Tanaka, Kishiwada; Keizo Kimoto, Hirakata; Tadashi Sakuma, Sakai, all of Japan

[73] Assignee: Mita Industrial Co., Ltd., Osaka, Japan

[21] Appl. No.: 763,150

[22] Filed: Sep. 20, 1991

Related U.S. Application Data

[63] Continuation-in-part of Ser. No. 521,345, May 9, 1990, abandoned.

[30] Foreign Application Priority Data

May 9, 1989 [JP] Japan ..... 1-114308
Nov. 30, 1989 [JP] Japan ..... 1-313645

[51] Int. Cl.[5] ..... G03G 5/047
[52] U.S. Cl. ..... 430/59; 430/58
[58] Field of Search ..... 430/58, 59

[56] References Cited

U.S. PATENT DOCUMENTS 4,563,408 1/1986 Liu et al. ..... 430/59
4,743,521 5/1988 Hoffmann et al. ..... 430/59 X
4,971,875 11/1990 Gregory et al. ..... 430/59
4,988,595 1/1991 Pai et al. ..... 430/59

FOREIGN PATENT DOCUMENTS 24146 2/1983 Japan ..... 430/59

*Primary Examiner*—Roland Martin
*Attorney, Agent, or Firm*—Sherman and Shalloway

[57] ABSTRACT

Disclosed is a laminate type photosensitive material for the electrophotography, which comprises a charge-generating layer and a charge-transporting layer, which are formed on an electroconductive substrate, wherein the charge-transporting layer comprises a first charge-transporting material having an ionization potential smaller than that of a charge-generating material used for the charge-generating layer and a second charge-transporting material having an ionization potential larger than that of the charge-generating material.

In this photosensitive material, by using a charge-transporting material having an ionization potential larger than that of the charge-generating material in combination with the charge-transporting material having an ionization potential smaller than that of the charge-generating material, a good residual potential can be maintained without disturbing injection of holes in the charge-transporting layer, the stability of the surface potential at the repeated use is improved and a good charging capacity can be attained.

10 Claims, 7 Drawing Sheets

EXAMPLE 2

EXAMPLE 4 (COMPARATIVE EXAMPLE)

EXAMPLE 5 (COMPARATIVE EXAMPLE)

LAMINATE TYPE PHOTOSENSITIVE MATERIAL FOR ELECTROPHOTOGRAPHY

This application is a continuation-in-part application of the application Ser. No. 07/521,345 filed on May 9, 1990, which has now been abandoned.

BACKGROUND OF THE INVENTION (1) Field of the Invention

The present invention relates to a laminate type photosensitive material for electrophotography, which comprises a charge-generating layer and a charge-transporting layer, which are formed on an electroconductive substrate.

(2) Description of the Related Art

A laminate type photosensitive material having the above-mentioned structure has been publicly known as the so-called function-separated photosensitive material.

In this laminate type photosensitive material, by the imagewise exposure conducted after, for example, negative charges have been uniformly given to the surface, carriers (positive or negative charges) are generated in the charge-generating layer and injection and transportation of holes (positive holes) are effected in the charge-transporting layer based on these carriers, whereby the negative charges on the surface of the photosensitive material are neutralized and an electrostatic latent image is formed.

Accordingly, in the conventional laminate type photosensitive material, in order to facilitate the injection of holes, a substance having a higher ionization potential than that of the charge-transporting substance is used as the charge-generating substance.

However, if the charge-generating material and the charge-transporting material are used in the above-mentioned combination, when the photosensitive material is used repeatedly, the stability of the surface potential is bad.

Recently, incorporation of an antioxidant into the charge-transporting layer has been proposed as the means for preventing light deterioration or thermal deterioration of the photosensitive material and improving the stability at the repeated use. However, some of the various antioxidants heretofore used for photosensitive materials for electrophotography fail to show a significant effect but have bad influences on the photosensitive characteristics.

SUMMARY OF THE INVENTION

It is therefore a primary object of the present invention to provide a laminate type photosensitive material for electrophotography, in which reduction of the surface potential of the photosensitive material is effectively prevented even after repeated use without disturbing the injection of holes into the charge-transporting layer and a good charging capacity is manifested while maintaining a good residual potential.

Another object of the present invention is to provide a laminate type photosensitive material for electrophotography, in which the stability after repeated use is improved by preventing the deterioration by light or heat.

In accordance with the present invention, there is provided a laminate type photosensitive material for electrophotography, which comprises a charge-generating layer and a charge-transporting layer, which are formed on an electroconductive substrate, wherein the charge-transporting layer comprises a first charge-transporting material having an ionization potential smaller than that of a charge-generating material used for the charge-generating layer and a second charge-transporting material having an ionization potential larger than that of the charge-generating material.

The present invention is prominently characterized in that a charge-transporting material having an ionization potential smaller than that of an charge-generating material used for the charge-generating layer and a charge-transport-material having an ionization potential larger than that of the charge-generating material are used in combination as the charge-transporting material constituting the charge-transporting layer.

If only a charge-transporting material having an ionization potential smaller than that of the charge-generating material is used as in the conventional technique, although the injection of holes into the charge-transporting layer can be performed effectively, the disadvantage of reduction of the surface potential of the photosensitive material by repeated use cannot be avoided.

In contrast, if two kinds of the above-mentioned charge-transporting materials are used in combination according to the present invention, as is apparent from the examples, reduction of the surface potential of the photosensitive material after repeated use can be effectively prevented.

More specifically, as the result of investigations made by us, it was found that if substances having an ionization potential larger and an ionization potential smaller than that of the charge-generating material used for the charge-generating layer, respectively, are combined and used as the charge-transporting material so that each of the differences of the absolute values of the ionization potentials of the two charge-transporting materials from that of the charge-generating material is within 0.2 eV, a good residual potential can be maintained without disturbing the injection of holes in the charge-transporting layer, and a good charging capacity is attained.

Furthermore, as the result of research made by us, it was found that in a photosensitive material where two kinds of the above-mentioned charge-transporting materials are used in combination, if a phosphorus type or amine type antioxidant as used for the conventional photosensitive materials is used, the desired stability after repeated used is not obtained but the surface potential is drastically reduced by repeated use, and that if a phenol type antioxidant is used, stability after repeated use is preferably improved.

BRIEF DESCRIPTION OF THE DRAWINGS

In FIGS. 3 to 7, CTM1 represents charge-transporting materials having larger ionization potentials.

DETAILED DESCRIPTION OF THE PREFERRED EMBODIMENTS

Figure 1:
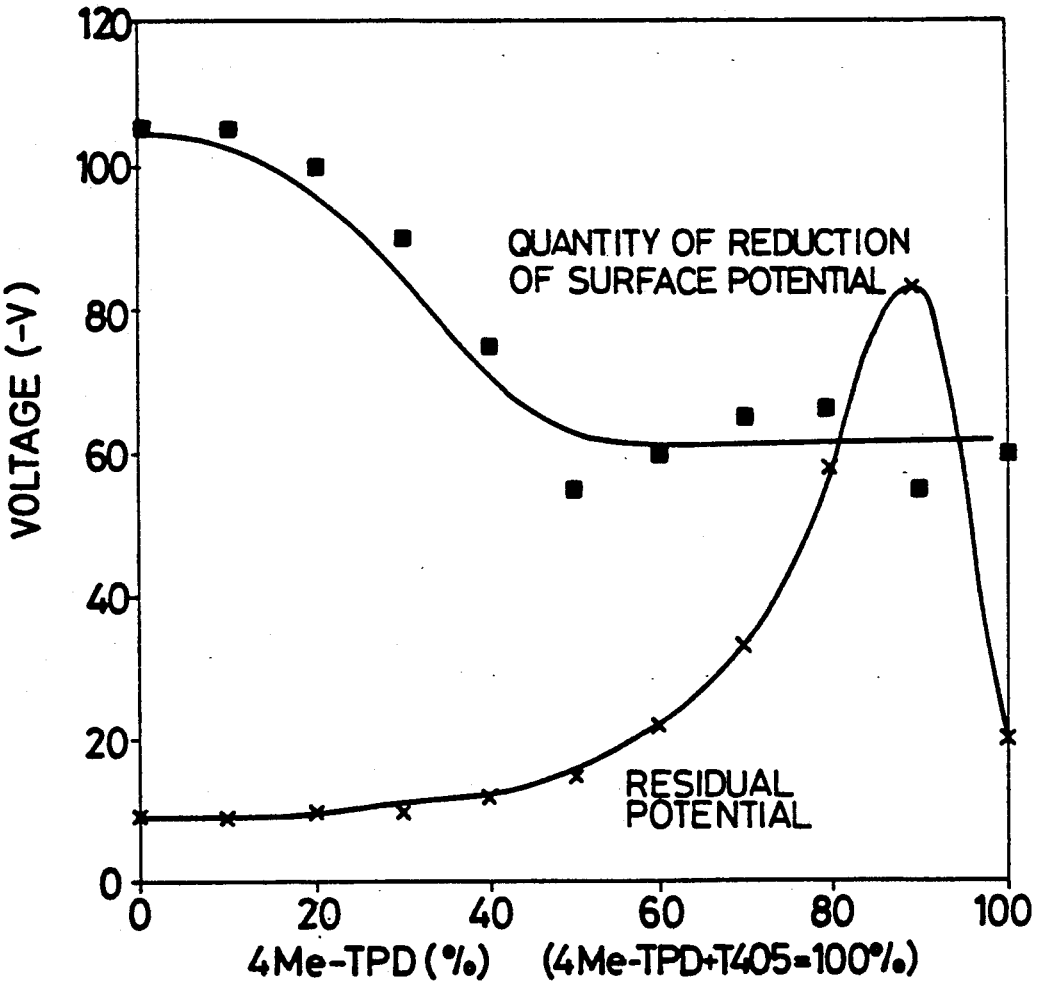
FIG. 1 is a graph illustrating the relations of the ratio of the combined charge-transporting materials to the quantity of reduction of the surface potential and the residual potential.

The laminate type photosensitive material of the present invention comprises an electroconductive substrate, a charge-generating layer formed on the substrate and a charge-transporting layer formed on the charge-generating layer.

Electroconductive Substrate

A sheet or drum formed of a foil or sheet of a metal such as aluminum, copper or tin or a tin plate is used as the electroconductive substrate.

Furthermore, a substrate formed by depositing a metal as mentioned above on a film substrate such as a biaxially drawn polyester film or a glass substrate by vacuum deposition, sputtering or electroless plating can be used. Moreover, an electroconductively treated paper sheet can be used.

Charge-Generating Layer

The charge-generating layer formed on the above-mentioned electroconductive substrate is formed of a dispersion of a charge-generating material in an electrically insulating binder resin.

Known electrically insulating materials can be used. For example, a polyester resin, an acrylic resin, a styrene resin, an epoxy resin, a silicone resin, an alkyd resin and a vinyl chloride/vinyl acetate copolymer resin can be used.

Any of materials capable of generating carriers on receipt of light, known in the field of electrophotography, can be used as the charge-generating material.

For example, there can be mentioned a phthalocyanine pigment, a perylene pigment, a quinacridone pigment, a pyranthrone pigment, a disazo pigment and a trisazo pigment.

In general, the charge-generating material is finely dispersed in the form of particles having a particle size smaller than 5 microns in the binder resin, and the charge-generating material is used in an amount of 5 to 100 parts by weight, especially 10 to 50 parts by weight, per 100 parts by weight of the binder resin.

In general, the charge-generating layer is formed in a thickness of 0.05 to 3 μm, especially 0.3 to 1 μm.

The structures and ionization potentials of main charge-generating materials are shown in Table 1.

TABLE 1

| Charge-Generating Material | Structure | Ionization Potential (eV) |
|---|---|---|
| lead phthalocyanine | 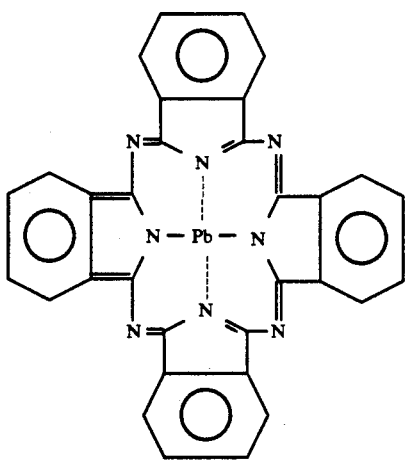 | 5.3 |
| TiO phthalocyanine | Structure in which Pb in above structure is changed to TiO | 5.32 |
| metal-free phthalocyanine | Structure in which Pb in above structure is changed to $H_2$ | 5.38 |
| brominated anthanthrone | 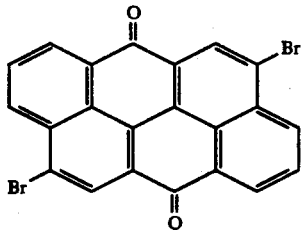 | 5.44 |
| perylene pigment | 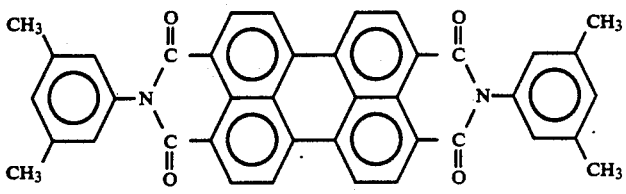 | 5.70 |

TABLE 1-continued

| Charge-Generating Material | Structure | Ionization Potential (eV) |
|---|---|---|
| azo pigment | 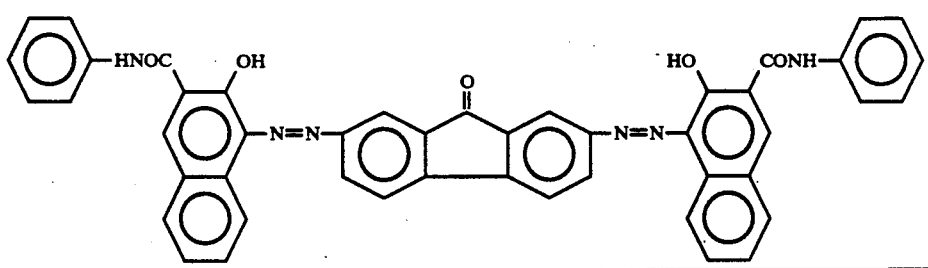 | 5.9 |

Charge-Transporting Layer

The charge-transporting layer formed on the charge-generating layer is formed of a dispersion of a charge-transporting material in an binder resin as described above with respect to the charge-generating layer. In the present invention, a first charge-transporting material having an ionization potential smaller than that of the used charge-generating material and a second charge-generating material having an ionization potential larger than that of the used charge-generating material are used in combination as the charge-transporting material.

Known charge-transporting materials can be used in the present invention, and two kinds of charge-generating materials satisfying the above requirement are used in combination.

Main charge-transporting materials and ionization potentials thereof are shown in Table 2.

TABLE 2

| | Charge-Transporting Material | Ionization Potential (eV) |
|---|---|---|
| No. 1 | stilbene | 5.62 |
| No. 2 | N,N'-bis(o,p-dimethylphenyl)-N,N'-(diphenyl)benzidine | 5.43 |
| No. 3 | 1,1-bis(p-diethylaminophenyl)-4,4-diphenyl-1,3-butadiene | 5.32 |
| No. 4 | N,N-diethylaminobenzaldehyde-N,N-diphenylhydrazone | 5.23 |
| No. 5 | N,N-dimethylaminobenzaldehyde-N,N-diphenylhydrazone | 5.28 |
| No. 6 | N-methyl-N-phenylam-nobenzaldehyde-N,N-diphenylhydrazone | 5.47 |
| No. 7 | 4-diphenylamino-α-phenylstilbene | 5.6 |
| No. 8 | triphenylamine | 5.74 |
| No. 9 | 4-(N,N-diethylamino)benzaldehyde-N,N-diphenylhydrazone | 5.23 |

It is preferred that the difference of each of the ionization potentials of the first and second charge-transporting materials from that of the charge-generating material be within ±0.2 eV.

More specifically, if the ionization potential of the first charge-transporting material is too small, the reduction of the surface potential is too large, and if the ionization potential (abbreviated to "Ip" hereinafter) of the second charge-transporting material is too large, the injection of holes becomes difficult and the accumulation of residual charges tends to increase.

It is preferred that the first charge-transporting material and second charge-transportion material be used in such amounts that the weight ratio of the first charge-transporting material to the second charge-transporting material be from 10/90 to 90/10, especially from 30/70 to 70/30.

For example, in case of a laminate photosensitive material comprising metal-free phthalocyanine (Ip: 5.38 eV) as the charge-generating material, N,N'-(o,p-dimethylphenyl)-N,N'-(diphenylbenzidine (hereinafter referred to as "4Me-TPD") having an Ip value of 5.43 eV as the second charge-transporting material and 1,1-bis(p-diethylaminophenyl)-4,4-diphenyl)-4,4-diphenyl-1,3-butadiene (hereinafter referred to as "T-405") having an Ip value of 5.32 eV as the first charge-transporting material, the relation among the quantity of reduction of the surface potential from the initial value, the residual potential and the combination ratio between the charge-transporting materials, observed at the 200-cycle copying test, is as shown in FIG. 1.

From the results shown in FIG. 1, it will be understood that if the amount incorporated of 4Me-TPD as the second charge-transporting material is small, reduction of the surface potential is conspicuous and if the amount incorporated of 4Me-TPD is large, the residual potential is adversely influenced, and that when the first and second charge-transporting materials are used at the combination ratio specified in the present invention, very good results can be obtained.

The charge-transporting materials are used in a total amount of 50 to 300 parts by weight, especially 70 to 100 parts by weight, per 100 parts by weight of the binder resin.

Phenol Type Antioxidant

In the present invention, furthermore, the phenol type antioxidant is blended in the charge-transporting layer to effectively prevent the photosensitive material from being deteriorated by the light or heat as well as to effectively avoid the surface potential of the photosensitive material from decreasing after repeated use. In this specification, the phenolic antioxidant consists of a phenol derivative having a phenolic hydroxyl group, i.e., an antioxidant of the type in which a radical is trapped by the phenolic hydroxyl group. For instance, those represented by the 4,4'-isopropylidene-diphenol alkyl phosphite have a phenolic hydroxyl group but trap the radical at a phosphite moiety. Therefore, they pertain to the phsphorus type antioxidant which is different from the phenol type antioxidant of the present invention.

As the phenol type antioxidant that can be used in the present invention, there can be mentioned butylhydroxytoluene, butylhydroxyanisole and a hindered phenol such as 2,6-t-butyl-p-cresol, triethylene glycol-bis 3-(3-t-butyl-5-methyl-4-hydroxyphenyl) propionate, octadecyl-3-(3,5-di-t-butyl-4-hydroxyphenyl) propionate, bis(1,2,2,6-pentamethyl-4-piperidyl) 2-(3,5-di-t-butyl-4-hydroxybenzyl)-2-n-butylmalonate and 4,4'-thiobis(3-methyl-6-t-butylphenol). These phenol type antioxidants can be used singly or in the form of mixtures of two or more of them. Among these antioxidants, a hindered phenol, preferably octadecyl-3-(3,5-di-t-butyl-4-hydroxydiphenyl) propionate and bis(1,2,2,6-pentamethyl-4-piperidyl) 2-(3,5-di-t-butyl-4-hydroxybenzyl)-2-n-butyl-malonate are used.

The phenol type antioxidant is used in an amount of 5 to 50 parts by weight per 100 parts by weight of the binder resin. If the amount used of the phenol type antioxidant exceeds 50 parts by weight, the sensitivity is reduced and the residual potential rises at the repeated use. If the amount of the phenol type antioxidant is smaller than 5 parts by weight, a sufficient stability of the surface potential cannot be obtained at the repeated use.

In general, the charge-transporting layer is formed in a thickness of 10 to 30 μm, especially 15 to 20 μm.

The present invention will now be described in detail with reference to the following examples that by no means limit the scope of the invention.

(Preparation of Photosensitive Material for Electrophotography)

EXAMPLES

Evaluation of the photosensitive materials for electrophotography:

Photosensitive materials for electrophotography prepared in the below-mentioned Examples were evaluated by measuring their electrophotographic characteristics (charging capacity and residual potential) in compliance with the method mentioned below.

Figure 2:
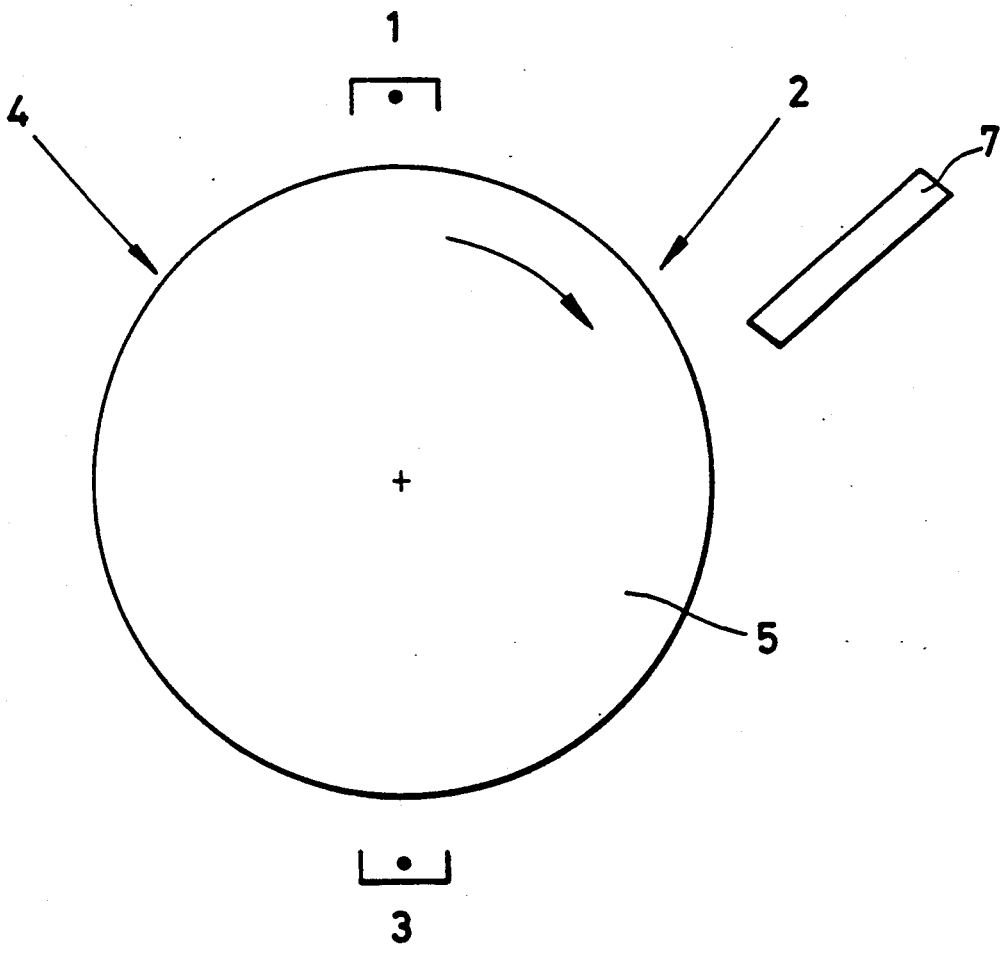
FIG. 2 is a diagram illustrating an apparatus for use in the electrophotographic characteristics of a photosensitive material.

That is, by using the apparatus shown in FIG. 2, the photosensitive material 5 for electrophotography obtained in each Example was negatively charged by the corona discharge at −6 KV by using Corotron 1 while rotating the photosensitive material 5, and the surface potential $V_{sp}$ (V) was measured using a surface potentiometer disposed at a position 7.

By using a semiconductor laser 2 (λ=780 nm, exposure intensity=0.7 mW/cm$^2$, exposure time=260 usec), the photosensitive material was exposed to light and the surface potential after the passage of 400 msec from the exposure to light was measured as the residual potential $V_{rp}$ (V).

Then, the corona discharge was carried out at +4 KV using Corotron 3, and the photosensitive material was exposed to light by using an LED (λ=780 nm) followed by a step 4 of removing electricity.

The surface potential $V_{1000SP}$ (V) was measured after the above step of electrophotography was carried out 1000 times, and a difference from the initial surface potential $V_{sp}$ (V) of the photosensitive material was calculated as $\Delta V_{sp}$ (V).

EXAMPLE 1

A ball mill was charged with 100 parts by weight of a polyvinyl butyral (trade name: S-Lec BL1 produced by Sekisui Kagaku Co.) as a binder, 200 parts by weight of a metal-free phthalocyanine (ionization potential, 5.38) as a charge-generating material and a predetermined amount of tetrahydrofuran. The mixture was stirred for 24 hours to obtain a coating liquid for forming a charge-generating layer. The coating liquid was applied onto an aluminum drum by the dipping method and was cured by drying with the hot air heated at 110° C. for 30 minutes in order to form a charge-generating layer having a thickness of 0.5 μm.

Next, 100 parts by weight of a polycarbonate resin (trade name: Upiron produced by Mitsubishi Gas Kagaku Co.), as a binder an N,N'-(o,p-dimethylphenyl)-N,N'-(diphenyl) benzidine (No. 2, ionization potential, 5.43) and a 1,1-bus(p-diethylaminophenyl)-4,4-diphenyl-1,3-butadiene (No. 3, ionization potential, 5.32) as charge-transporting materials in amounts as shown in Table 3, and a predetermined amount of toluene were mixed and stirred using a homomixer to prepare a coating liquid for forming a charge-transporting layer.

The coating liquid was applied onto the surface of the above-mentioned charge-generating layer by the dipping method and was dried with the hot air heated at 110° C. for 30 minutes in order to form a charge-transporting layer having a thickness of about 20 μm thereby to obtain a laminate type photosensitive material for electrophotography.

Figure 3:
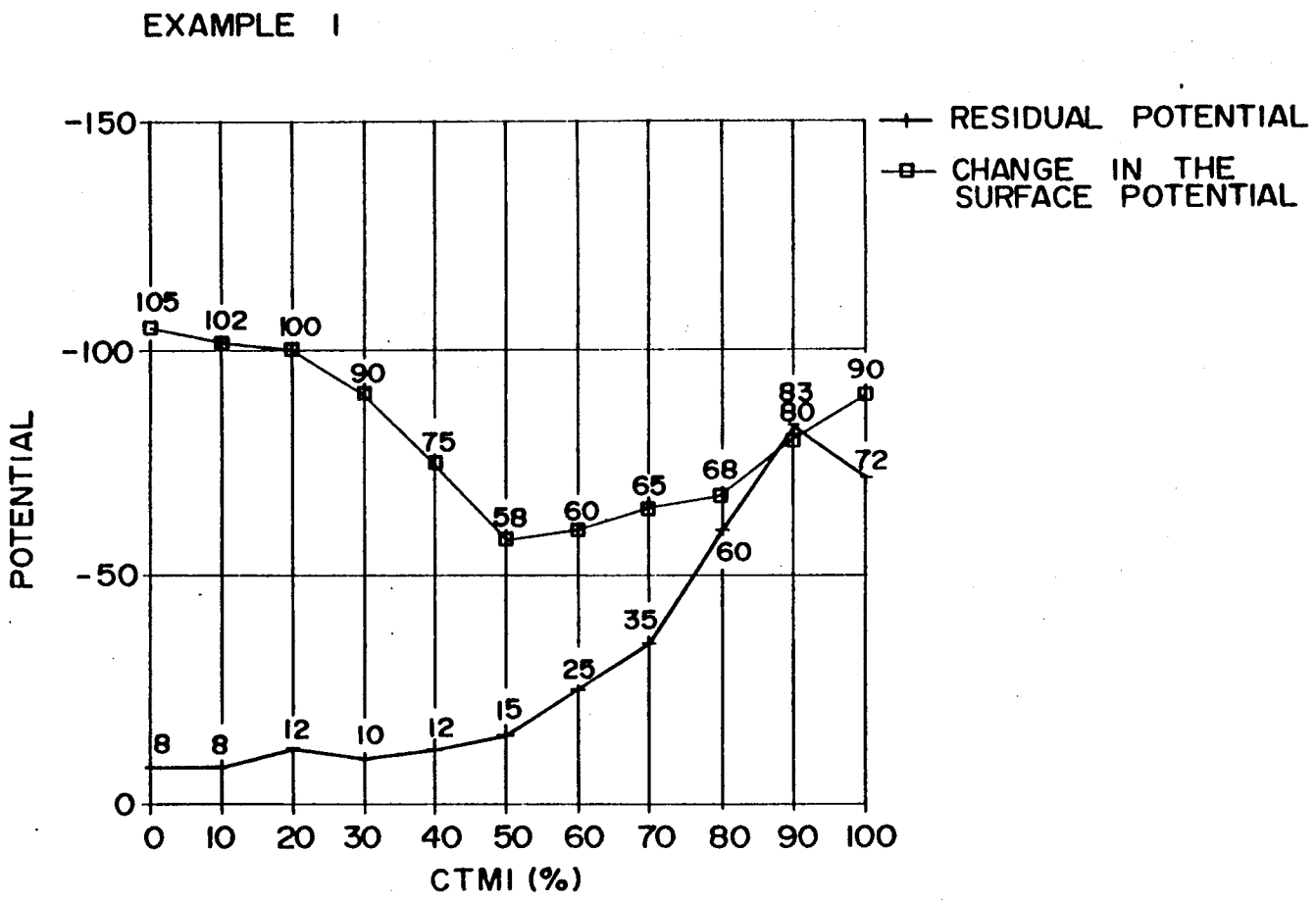
FIGS. 3 to 7 are diagrams showing the measured results of residual voltages and changes in the surface potential of the photosensitive materials in the Examples 1 to 5.

Table 3 and FIG. 3 show residual potential $V_{rp}$ (V) and changes $\Delta V_{sp}$ (V) in the surface potential of the thus obtained photosensitive materials measured in compliance with the aforementioned method.

TABLE 3

| Charge-generating material (parts by weight) Metal-free phthalocyanine (5.38) | Charge-transporting material (parts by weight) No. 2 (5.43) | No. 3 (5.32) | Residual potential Vrp (V) | Change in the surface potential Δ Vsp (V) |
|---|---|---|---|---|
| 200 | 0 | 100 | −8 | −150 |
| | 10 | 90 | −8 | −102 |
| | 20 | 80 | −12 | −100 |
| | 30 | 70 | −10 | −90 |
| | 40 | 60 | −12 | −75 |
| | 50 | 50 | −15 | −58 |
| | 60 | 40 | −25 | −60 |
| | 70 | 30 | −35 | −65 |
| | 80 | 20 | −60 | −68 |
| | 90 | 10 | −83 | −80 |
| | 100 | 0 | −72 | −90 |

In the above Table, values in parentheses denote ionization potentials of the charge-generating material and charge-transporting material. The same holds hereinafter.

EXAMPLE 2

Photosensitive materials for electrophotography were prepared in the same manner as described in Example 1 with the exception of using 200 parts by weight of a brominated anthanthrone (ionization potential, 5.44), as a charge-generating material and an N-methyl-N-phenylaminobenzaldehyde-N,N-diphenyl hydrazone (No. 6, ionization potential, 5.47) and an N,N'-(o,p-dimethylphenyl)-N,N'-(diphenyl)benzidine (No. 2, ionization potential, 5.43) as charge-transporting materials in amounts shown in Table 4.

Figure 4:
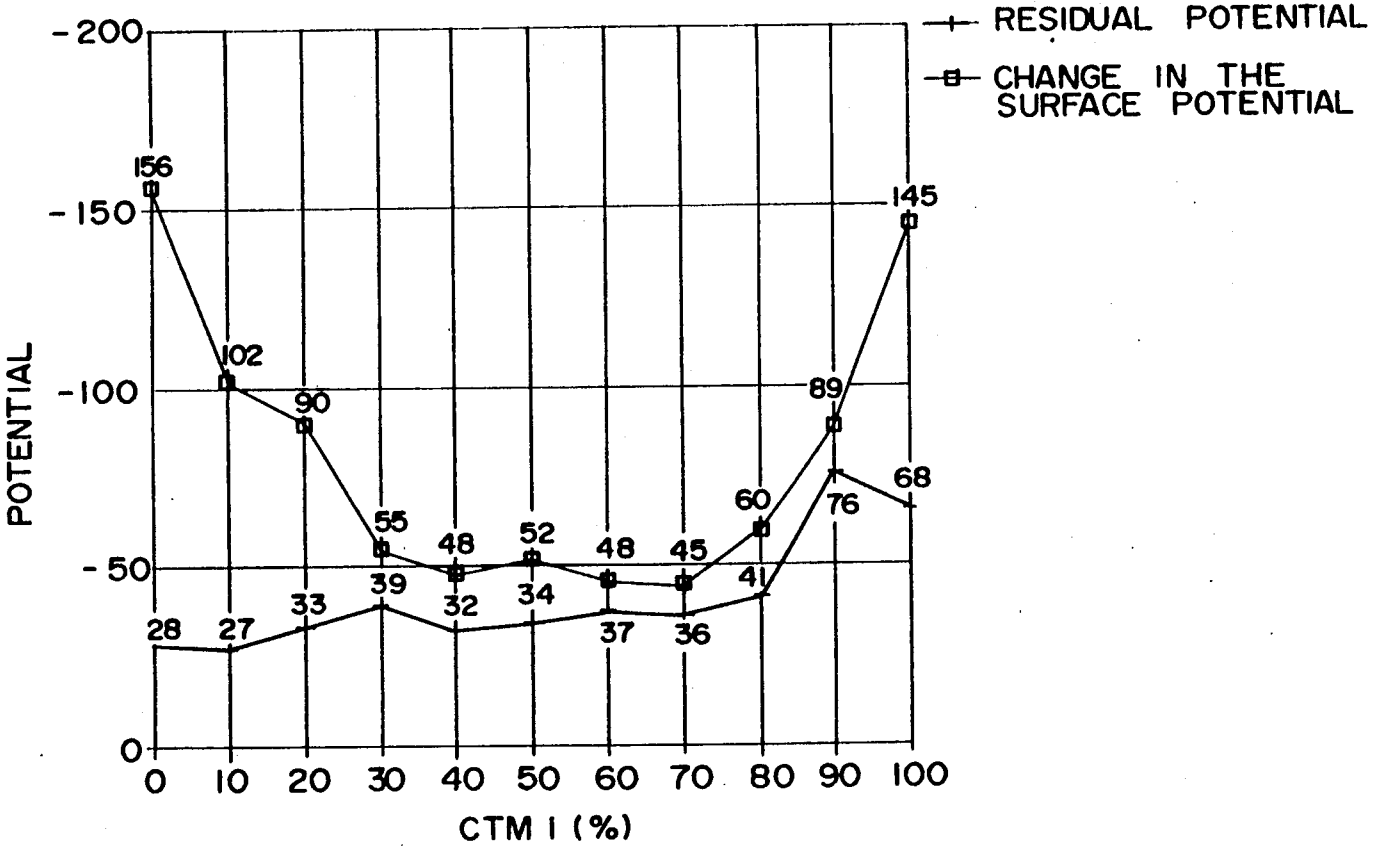

Table 4 and FIG. 4 show residual potentials $V_{rp}$ (V) and changes $\Delta V_{sp}$ (V) in the surface potential of the thus obtained photosensitive materials measured in compliance with the aforementioned method.

TABLE 4

| Charge-generating material (parts by weight) Brominated anthanthrone (5.44) | Charge-transporting material (parts by weight) No. 6 (5.47) | No. 2 (5.43) | Residual potential Vrp (V) | Change in the surface potential Δ Vsp (V) |
|---|---|---|---|---|
| 200 | 0 | 100 | −28 | −156 |
| | 10 | 90 | −27 | −102 |
| | 20 | 80 | −33 | −90 |
| | 30 | 70 | −39 | −55 |
| | 40 | 60 | −32 | −48 |
| | 50 | 50 | −34 | −52 |
| | 60 | 40 | −37 | −46 |
| | 70 | 30 | −36 | −45 |
| | 80 | 20 | −41 | −60 |
| | 90 | 10 | −76 | −89 |
| | 100 | 0 | −66 | −145 |

EXAMPLE 3

Photosensitive materials for electrophotography were prepared in the same manner as described in Example 1 with the exception of using 200 parts by weight of a perylene pigment (ionization potential, 5.70) as a charge-generating material and a triphenylamine (No. 8, ionization potential, 5.74) and a stilbene (No. 1, ionization potential, 5.62) as charge-transporting materials in amounts shown in Table 5.

Figure 5:
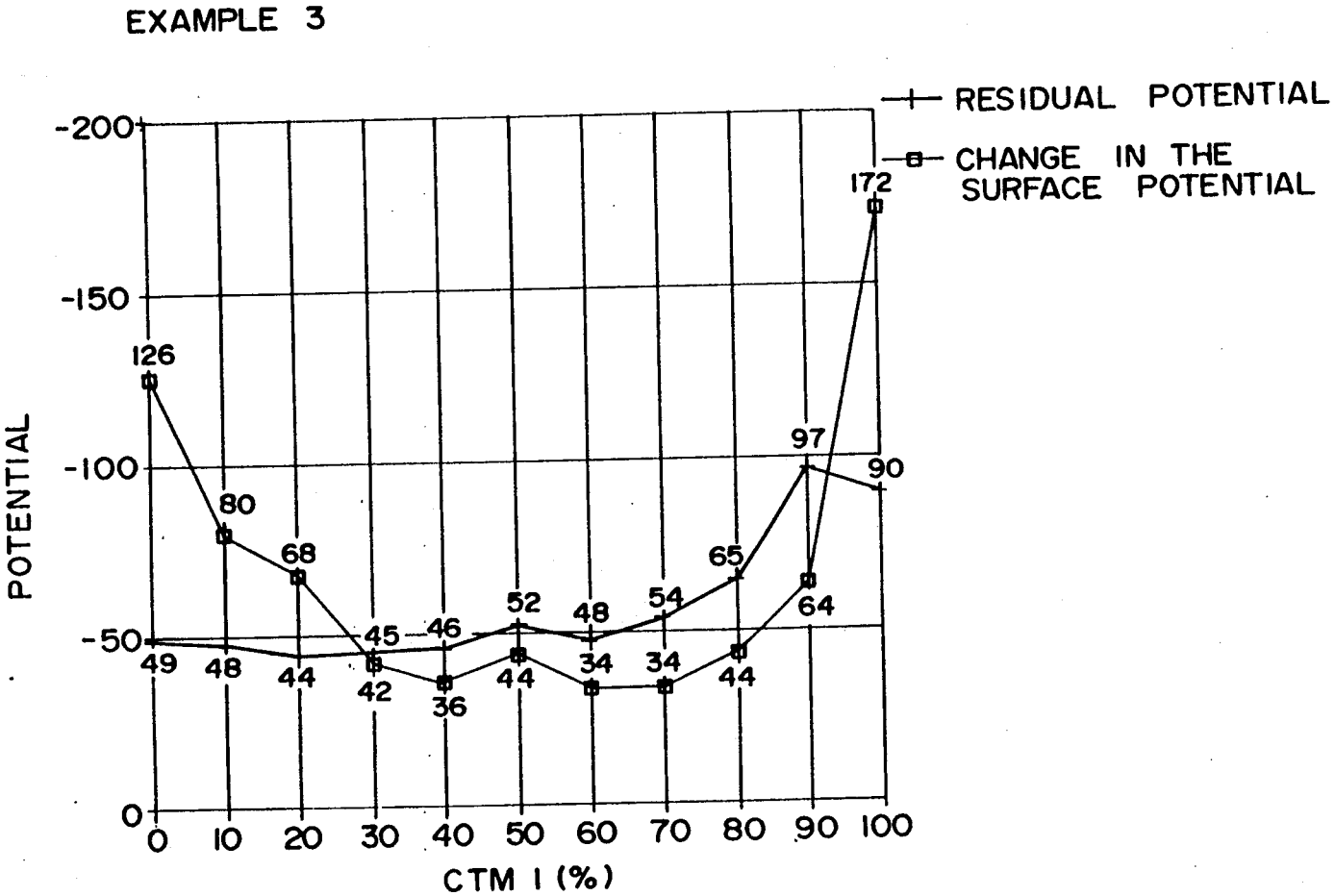

Table 5 and FIG. 5 show residual potentials $V_{rp}$ (V) and changes $\Delta V_{sp}$ (V) in the surface potential of the thus obtained photosensitive materials measured in compliance with the aforementioned method.

TABLE 5

| Charge-generating material (parts by weight) Perylene pigment (5.70) | Charge-transporting material (parts by weight) No. 8 (5.74) | No. 1 (5.62) | Residual potential Vrp (V) | Change in the surface potential Δ Vsp (V) |
|---|---|---|---|---|
| 200 | 0 | 100 | −49 | −126 |
| | 10 | 90 | −48 | −80 |
| | 20 | 80 | −44 | −68 |
| | 30 | 70 | −45 | −42 |
| | 40 | 60 | −46 | −36 |
| | 50 | 50 | −52 | −44 |
| | 60 | 40 | −48 | −34 |
| | 70 | 30 | −54 | −34 |
| | 80 | 20 | −65 | −44 |
| | 90 | 10 | −97 | −64 |
| | 100 | 0 | −90 | −172 |

EXAMPLE 4

(Comparative Example)

Photosensitive materials for electrophotography were prepared in the same manner as described in Example 1 with the exception of using 200 parts by weight of a perylene pigment (ionization potential, 5.70) as a charge-generating material and a stilbene (No. 1, ionization potential, 5.62) and an N,N'-(o,p-dimethylphenyl)-N,N'-(diphenyl)benzidene (No. 2, ionization potential, 5.43) as charge-transporting materials in amounts shown in Table 6.

Figure 6:
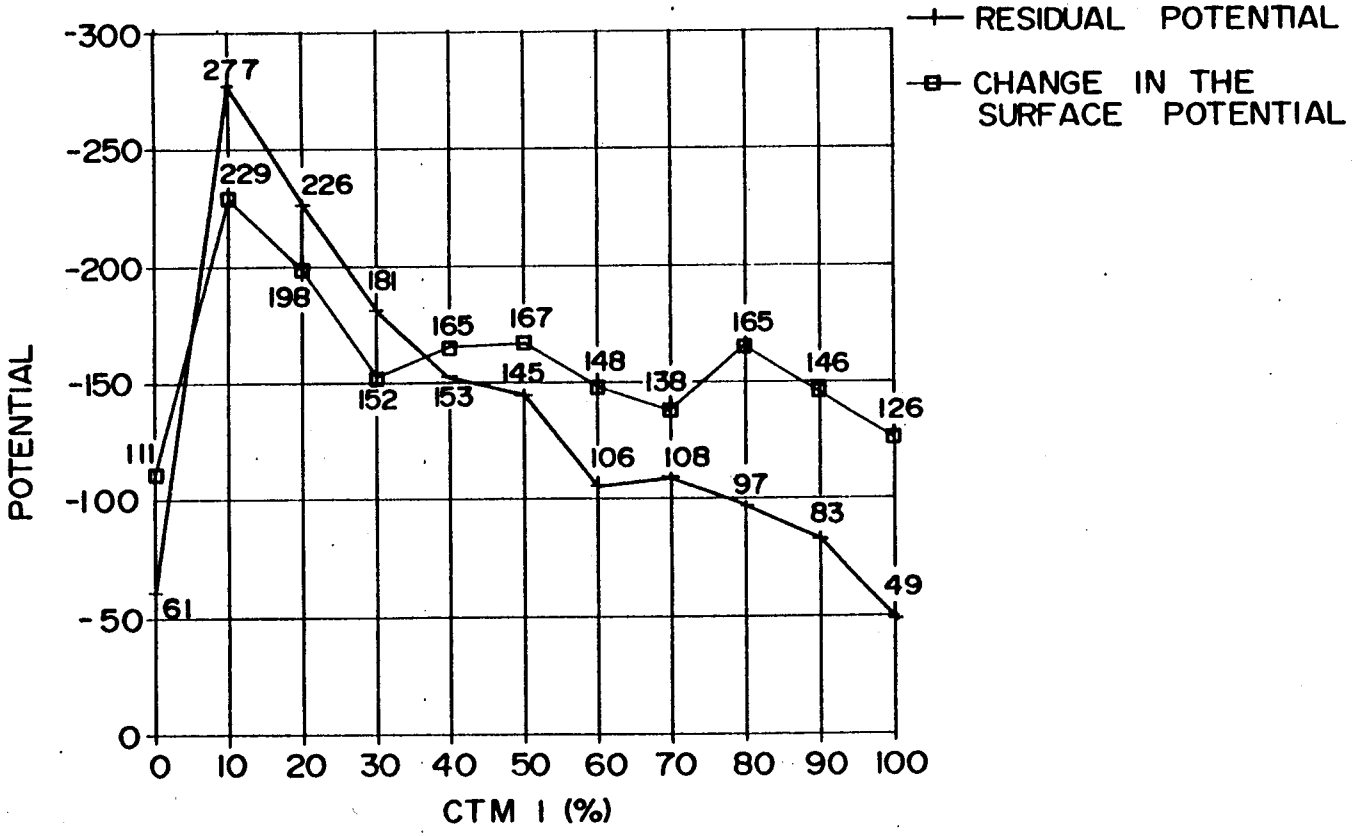

Table 6 and FIG. 6 show residual potentials $V_{rp}$ (V) and charges $\Delta V_{sp}$ (V) in the surface potential of the thus obtained photosensitive materials measured in compliance with the aforementioned method.

TABLE 6

| Charge-generating material (parts by weight) Perylene pigment (5.70) | Charge-transporting material (parts by weight) No. 1 (5.62) | No. 2 (5.43) | Residual potential Vrp (V) | Change in the surface potential Δ Vsp (V) |
|---|---|---|---|---|
| 200 | 0 | 100 | −61 | −111 |
| | 10 | 90 | −277 | −229 |
| | 20 | 80 | −226 | −199 |
| | 30 | 70 | −181 | −152 |
| | 40 | 60 | −153 | −165 |
| | 50 | 50 | −145 | −167 |
| | 60 | 40 | −106 | −148 |
| | 70 | 30 | −109 | −138 |
| | 80 | 20 | −97 | −165 |
| | 90 | 10 | −83 | −146 |
| | 100 | 0 | −49 | −126 |

EXAMPLE 5

(Comparative Example)

Photosensitive materials for electrophotography were prepared in the same manner as described in Example 1 with the exception of using a stilbene (No. 1, ionization potential, 5.62) and an N-methyl-N-phenylaminobenzaldehyde-N,N-diphenyl hydrazone (No. 6, ionization potential, 5.47) as charge-transporting materials in amounts shown in Table 7.

Figure 7:
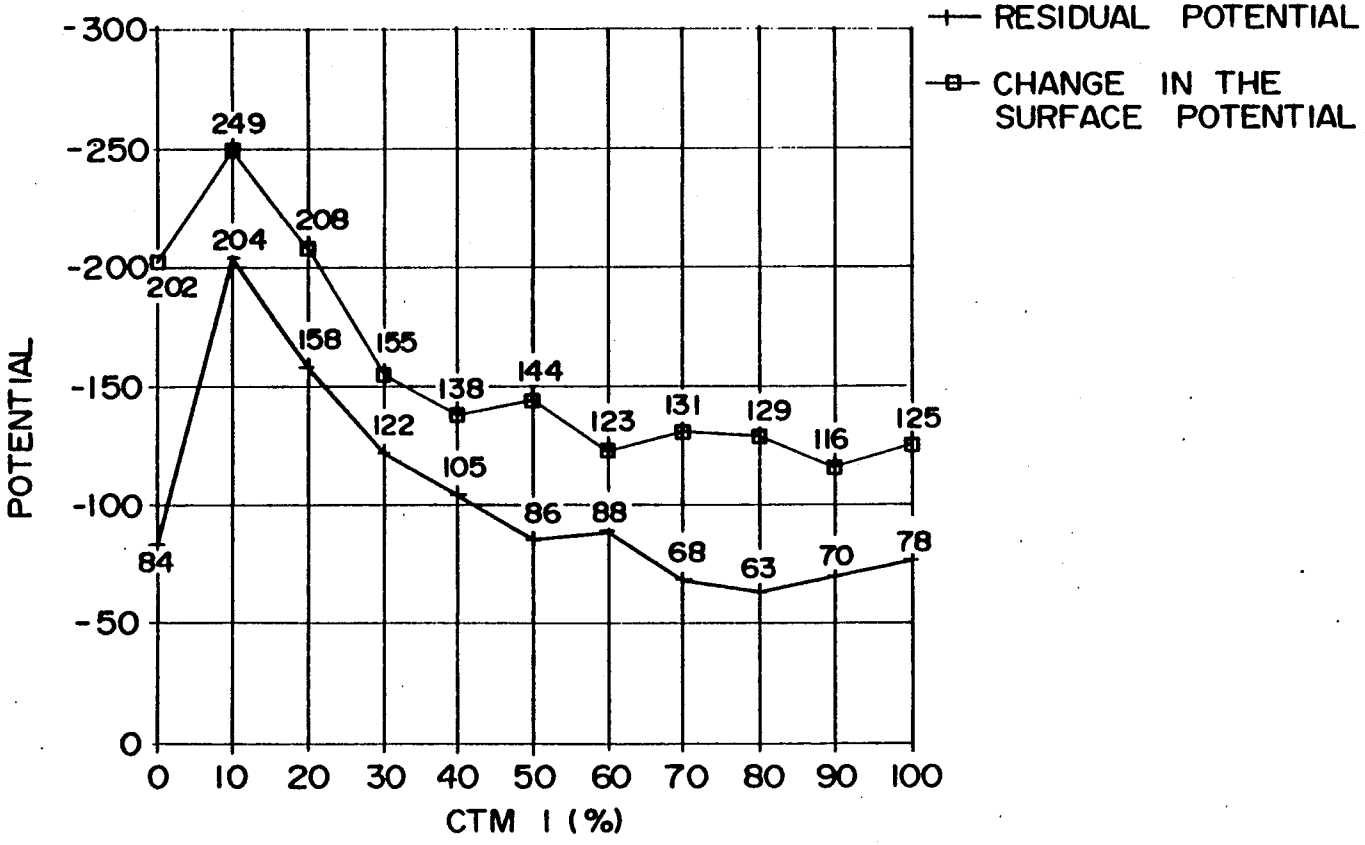

Table 7 and FIG. 7 show residual potential $V_{rp}$ (V) and changes $\Delta V_{sp}$ (V) in the surface potential of the thus obtained photosensitive materials measured in compliance with the aforementioned method.

TABLE 7

| Charge-generating material (parts by weight) Metal-free phthalocyanine (5.38) | Charge-transporting material (parts by weight) No. 1 (5.62) | No. 2 (5.47) | Residual potential Vrp (V) | Change in the surface potential Δ Vsp (V) |
|---|---|---|---|---|
| 200 | 0 | 100 | −84 | −202 |
| | 10 | 90 | −204 | −249 |
| | 20 | 80 | −158 | −208 |
| | 30 | 70 | −122 | −155 |
| | 40 | 60 | −105 | −138 |
| | 50 | 50 | −86 | −144 |
| | 60 | 40 | −89 | −123 |
| | 70 | 30 | −68 | −131 |
| | 80 | 20 | −63 | −129 |
| | 90 | 10 | −70 | −116 |
| | 100 | 0 | −76 | −125 |

EXAMPLE 6

(antioxidant added)

A ball mill was charged with 100 parts by weight of a polyvinyl butyral (trade name: S-Lec BL1 produced by Sekisui Kagaku Co.) as a binder, 200 parts by weight of a metal-free phthalocyanine (ionization potential, 5.38) as a charge-generating material and a predetermined amount of tetrahydrofuran. The mixture was stirred for 24 hours to obtain a coating liquid for forming a charge-generating layer. The coating liquid was applied onto an aluminum drum by the dipping method and was cured by drying with the hot air heated at 110° C. for 30 minutes in order to form a charge-generating layer having a thickness of 0.5 μm.

Next, 100 parts by weight of a polycarbonate resin (trade name: Upiron produced by Mitsubishi Gas Kagaku Co.) as a binder, 70 parts by weight of an N,N'-(o,p-dimethylphenyl)-N,N'-(diphenyl)benzidene (No. 2, ionization potential, 5.43) and 30 parts by weight of a 1,1-bis(p-diethylaminophenyl)-4,4-diphenyl-1,3-butadiene (No. 3, ionization potential, 5.32) as charge-transporting materials, antioxidants shown in Table 8, and a predetermined amount of toluene, were mixed and stirred using a homomixer to prepare a coating liquid for forming a charge-transporting layer.

The coating liquid was applied to the surface of the above charge-generating layer by the dipping method and was dried with the hot air heated at 110° C. for 30 minutes in order to form a charge-transporting layer having a thickness of about 20 μm thereby to obtain a laminate type photosensitive material for electrophotography.

Table 8 shows residual potentials $V_{rp}$ (V) and changes $\Delta V_{sp}$ (V) in the surface potential of the thus obtained photosensitive materials measured in compliance with the aforementioned method.

The antioxidants that are used are as listed below:

2,6-di-butyl-p-cresol, produced by Kawaguchi Kagaku Co., trade name, BHT.

triethylene glycol bis [3-(3-t-butyl-5-methyl-4-hydroxyphenyl)propionate], produced by Ciba-Gaigy Co., trade name, IRGANOX 245.

octadecyl-3-(3,5-di-t-butyl-4-hydroxyphenyl)propionate, produced by Ciba-Gaigy Co., trade name, IRGANOX 1076.

bis(1,2,2,6,6-pentamethyl-4-piperidyl) 2-(3,5-di-t-butyl-4-hydroxybenzyl)-2-n-butyl malonate, produced by Ciba-Gaigy Co., trade name, TINUVIN 144.

4,4'-isopropylidene-diphenol alkyl ($C_{12}$ to $C_{15}$) phosphite, produced by Adeca-Argus, trade name, Mark 1500.

diisodecyl pentaerythritol diphosphite, produced by Sanko Kagaku Co., trade name, HIMO.

1,3-bis(dimethylaminopropyl)-2-thiourea, produced by Ouchi Shinko Kagaku Co., trade name, NOLAX NS10.

bis(2,2,6,6-tetramethyl-4-piperidyl)sebacate, produced by Sankyo Kagaku Co., trade name, SANOL 770.

TABLE 8

| No. | Antioxidant | | Amount (parts by weight) | Vrp (V) | Δ Vsp(V) |
|---|---|---|---|---|---|
| (Examples) | | | | | |
| 1 | BHT | phenol type | 5 | −11 | −50 |
| 2 | BHT | phenol type | 25 | −7 | −35 |
| 3 | BHT | phenol type | 50 | −15 | −30 |
| 4 | IRGANOX 245 | phenol type | 5 | −8 | −70 |
| 5 | IRGANOX 245 | phenol type | 25 | −8 | −40 |
| 6 | IRGANOX 245 | phenol type | 50 | −10 | −30 |
| 7 | IRGANOX 1076 | phenol type | 5 | −12 | −60 |
| 8 | IRGANOX 1076 | phenol type | 25 | −12 | −25 |
| 9 | IRGANOX 1076 | phenol type | 50 | −10 | −35 |
| 10 | TINUVIN 144 | phenol type | 5 | −15 | −25 |
| 11 | TINUVIN 144 | phenol type | 25 | −21 | −30 |
| 12 | TINUVIN 144 | phenol type | 50 | −50 | −30 |
| Comparative Example | | | | | |
| 13 | MARK 1500 | phosphorus type | 10 | −210 | −50 |
| 14 | HIRO | phosphorus type | 10 | −16 | −175 |
| 15 | NOLAX NA10 | amine type | 10 | −110 | −50 |
| 16 | SANOL | amine type | 10 | −165 | −25 |

We claim:

1. A laminate type photosensitive material for electrophotography, which comprises a charge-generating layer comprising a charge-generating material and a charge-transporting layer, which layers are formed on an electroconductive substrate, wherein the charge-transporting layer comprises a first charge-transporting material having an ionization potential smaller than that of the charge-generating material in the charge-generating layer and a second charge-transporting material having an ionization potential larger than that of the charge-generating material, wherein the differences of the ionization potentials of the first and second charge-transporting materials from the ionization potential of the charge-generating material are within ±0.2 eV and said first and second charge-transporting materials are used in such amounts that the first charge-transporting material/second charge-transporting material weight ratio is from 10/90 to 90/10.

2. A photosensitive material for the electrophotography according to claim 1, wherein the charge-transporting layer comprises the first and second charge-transporting materials and a phenolic antioxidant.

3. The photosensitive material for electrophotography according to claim 1 wherein the charge-transporting materials are present in an amount of about 50 to 300 parts by weight per 100 parts by weight of a binder resin within which the charge-transporting material is dispersed.

4. The photosensitive material for electrophotography according to claim 2 wherein the phenolic antioxidant comprises a mixture of two or more phenolic antioxidants.

5. The photosensitive material for electrophotography according to claim 4 wherein the phenolic antioxidant is octadecyl-3-(3,5-di-t-butyl-4-hydroxydiphenyl) propionate or bis(1,2,2,6-pentamethyl-4-piperidyl) 2-(3,5-di-t-butyl-4-hydroxybenzyl)-2-n-butyl-malonate.

6. The photosensitive material for electrophotography according to claim 2 wherein the phenolic antioxidant is present in an amount of about 5 to 50 parts by weight per 100 parts by weight of a binder resin within which the antioxidant is dispersed.

7. The photosensitive material for electrophotography according to claim 1 wherein the charge-transporting layer has a thickness of about 10 to 30 μm.

8. The photosensitive material for electrophotography according to claim 1 wherein the charge-transporting layer has a thickness of about 15 to 20 μm.

9. The photosensitive material for electrophotography according to claim 1, wherein the charge-generating material is selected from the group consisting of phthalocyanine pigment, perylene pigment, quinacridone pigment, pyranthrone pigment, disazo pigment and trisazo pigment and the charge-transporting materials are selected from the group consisting of stilbene, N,N'-bis(o,p-dimethylphenyl)-4,4'-(diphenyl) benzidine, 1,1-bis(p-diethylaminophenyl)-N,N'-diphenylhydrazone, N,N-diethylaminobenzaldehyde-N,N-diphenylhydrazone, N,N-dimethylaminobenazldehyde-N,N-diphenylhydrazone, N-methyl-N-phenylaminobenazldehyde-N,N-diphenylhydrazone, 4-diphenylamino-α-phenylstilbene, triphenylamine, and 4-(N,N-diethylamino)benzaldehyde-N,N-diphenylhydrazone.

10. The photosensitive material of claim 1 comprising metal-free phthalocyanine as the charge-generating material, N,N'-(o,p-dimethylphenyl)-N,N'-(diphenylbenzidine) as the second charge-transporting material and 1,1-bis(p-diethylaminophenyl)-4,4-diphenyl)-4,4-diphenyl-1,3-butadiene as the first charge-transporting material.

* * * * *